United States Patent [19]

Gontowski, Jr.

[11] Patent Number: 4,740,742

[45] Date of Patent: Apr. 26, 1988

[54] VOLTAGE REGULATOR START-UP CIRCUIT

[75] Inventor: Walter S. Gontowski, Jr., Thompson, Conn.

[73] Assignee: Cherry Semiconconductor Corporation, East Greenwich, R.I.

[21] Appl. No.: 33,586

[22] Filed: Apr. 2, 1987

[51] Int. Cl.[4] ..... G05F 3/20

[52] U.S. Cl. ..... 323/313; 323/901; 323/907

[58] Field of Search ..... 323/313, 314, 315, 316, 323/901, 907

[56] References Cited

U.S. PATENT DOCUMENTS

| | | | |
|---|---|---|---|
| 4,051,392 | 9/1977 | Rosenthal et al. | 323/901 |
| 4,333,047 | 6/1982 | Flink | 323/901 |
| 4,476,428 | 10/1984 | Iwasawa et al. | 323/901 |
| 4,567,426 | 1/1986 | van de Plassche et al. | 323/901 |

*Primary Examiner*—Peter S. Wong

*Attorney, Agent, or Firm*—Robert M. Asher

[57] ABSTRACT

A start-up circuit for a voltage regulator having a first current mirror for providing start-up current and a second current mirror responsive to voltage output from said regulator for turning off said first current mirror when said regulator is close to regulation. The circuitry providing start-up current and the circuitry turning off the start-up current having substantially the same temperature coefficients.

14 Claims, 1 Drawing Sheet

VOLTAGE REGULATOR START-UP CIRCUIT

BACKGROUND OF THE INVENTION

The present invention is directed to start-up circuits for voltage regulators, in particular band-gap regulators. Band-gap regulators are well known in the art. They provide a tightly regulated voltage with a low temperature coefficient. In order to prevent the regulator from changing the output voltage as the supply voltage varies, (Power Supply Rejection Ratio or PSRR), the regulator is normally biased via a constant current source. To achieve even a greater degree of PSRR, the current source reference current is normally derived from the band-gap regulator itself. This bias scheme though results in two stable states. The first is the normal regulating mode and the second a condition where the regulator does not "start-up" and remains off.

During the initial application of power to a band-gap regulator, some method must be provided to ensure that the regulator starts up. Normally a separate circuit is used to provide the initial start up current.

FIG. 1 is a schematic of a typical band-gap regulator and start-up circuit of the prior art. The band-gap regulator 10 has a terminal 12 for receiving start-up current, an output terminal 14 for providing the regulated voltage, an output terminal 16 for providing the regulated band-gap voltage, a ground pin 18 and a terminal 20 for receiving the source voltage. The start-up circuit of the prior art includes an input voltage 22 connected in series with a resistor 24 and a pair of diodes 26 and 28. The input voltage is typically about 3 volts. The base of a transistor 30 is connected between the pair of diodes and the resistor 24. The collector of the transistor 30 is connected to the start-up current terminal 12 of the band gap regulator and the emitter of the transistor 30 is connected to the band-gap voltage terminal 16. The voltage at the base of the transistor 30 is the sum of the forward voltages of the diodes, typically 1.2 V.

In operation, as power is supplied to the circuit, the regulated input voltage 22 supplies current to transistor 30. The diodes 26 and 28 clamp the base of the transistor 30 to the sum of the two forward voltages. The current pulled out of the start-up current terminal 12 by transistor 30 forces the bandgap regulator circuit 10 to start operating. In the regulator shown in FIG. 1, current mirror 11 begins conducting. As the regulator approaches proper operating conditions, the voltage on the emitter of transistor 30 begins to rise to the band-gap voltage which in this application is about 1.2 V. When the band-gap voltage gets high enough, the transistor 30 becomes reverse biased and stops conducting.

In practicing the prior art start-up circuit, it is necessary to ensure that the clamp voltage at the base of transistor 30 is sufficiently high in magnitude to ensure that the transistor 30 conducts enough current to start up the regulator. If the voltage at the base of transistor 30 is too low, it is possible that the regulator will reach a stable state somewhere between zero volts and the desired regulated voltage. Since it is necessary to provide two diodes 26 and 28 to ensure a high enough voltage, the start-up circuit has a net negative temperature coefficient. The temperature coefficients of diode 26 and transistor 30 cancel each other out, but the negative temperature coefficient of diode 28 then causes the voltage at the base of transistor 30 to rise at low temperatures. Since under regulation, the emitter of transistor held at a relatively stable voltage, it is possible that at low temperatures transistor 30 will eventually conduct thereby degrading the regulator's output voltage stability.

It is an object of the present invention to provide a start-up circuit for a band-gap regulator that is reliable over a large operating temperature range.

SUMMARY OF THE INVENTION

The start-up circuit of the present invention provides an input current to a current mirror. The output of the current mirror is provided for connection to the start-up current terminal of a band-gap regulator. A second current mirror is provided in the start-up circuit with an input portion connected to the regulated voltage output of a band-gap regulator. The output portion of the second current mirror is connected to the input current of the start-up circuit so that when sufficient current is received through the regulated voltage output, the second current mirror sinks all of the input current so that the first current mirror is shut off.

According to the present invention, the circuitry for turning on the start-up current has a temperature coefficient matched with that of the circuitry for turning off the start-up current. This enables the start-up circuit to operate properly over a wide temperature range.

Other objects and advantages of the invention will become apparent during the following description of the presently preferred embodiment of the invention taken in conjunction with the drawings.

DETAILED DESCRIPTION OF THE PREFERRED EMBODIMENT

Figure 1:
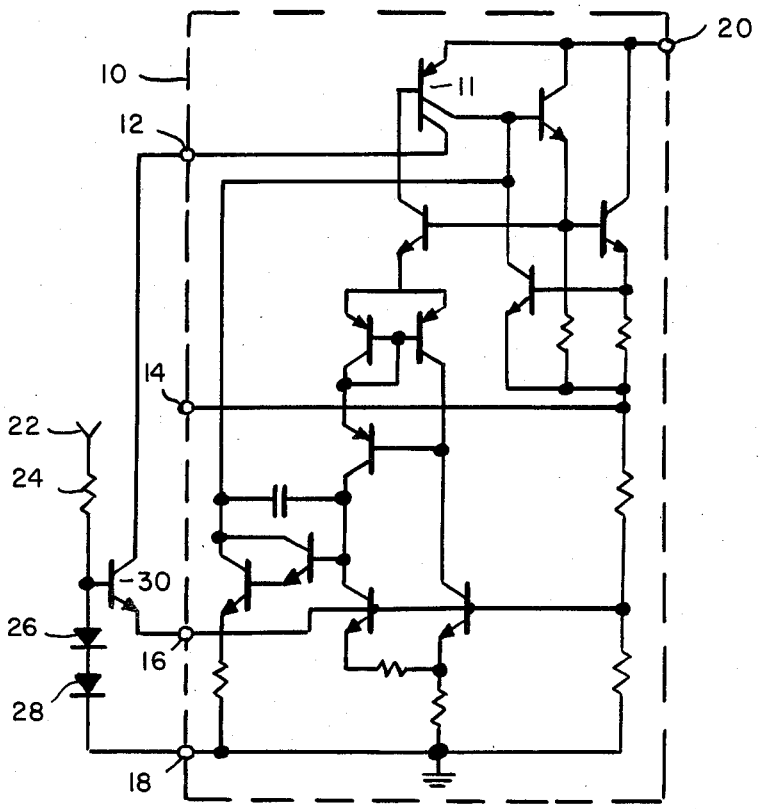
FIG. 1 PRIOR ART
FIG. 1 is a schematic diagram of a prior art start-up circuit for a band-gap regulator.
Figure 2:
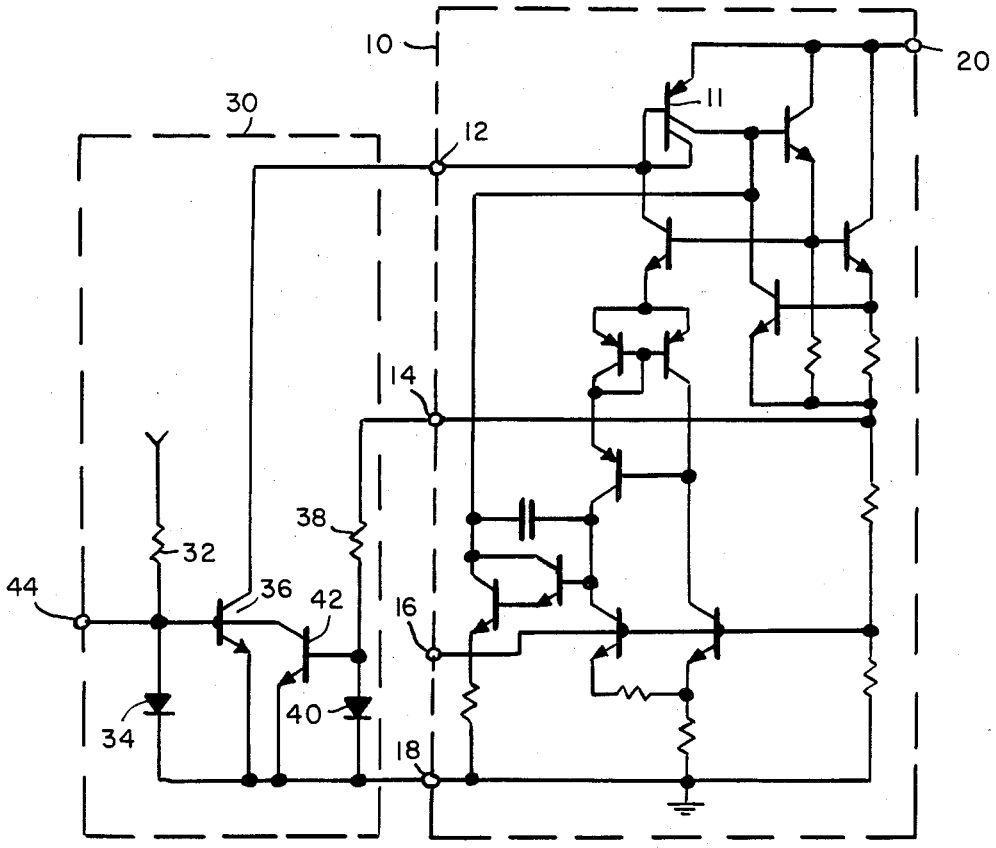
FIG. 2 is a schematic diagram of a start-up circuit of the present invention for a band-gap regulator.

Turning now to FIG. 2, a start-up circuit 30 of the present invention is shown. The start-up circuit 30 includes a source of input current. In the embodiment shown in FIG. 2, the input current is provided by a line which receives a voltage of 6.6 V. The voltage is provided through an input resistor 32. The input resistor 32 provides an input current to a current mirror formed by a diode 34 and a transistor 36. During start-up, the 6.6 V. is turned on and an input current, 100 microamps in the presently preferred embodiment, flows through diode 34, the input branch of the current mirror. This current is mirrored through transistor 36, the output branch of the current mirror. The collector of transistor 36 is connected to the start-up current terminal 12 of the band-gap regulator so as to provide the initial current in the regulator.

The start-up circuit of the present invention includes a second circuit for turning off the start-up current. This circuit includes a resistor 38 and a current mirror comprised of a diode 40 and a transistor 42. The resistor 38 is provided for connection to the regulated output voltage of the band-gap regulator. The current across resistor 38 created by this regulated voltage output also passes through the diode 40, the input branch of the current mirror. The current across resistor 38 is referred to as the shutoff current herein. The shutoff current is mirrored by the transistor 42, the output branch of the current mirror. The collector of transistor 42 is connected to the base of transistor 36 for receiving the input current from resistor 32. In the embodiment shown, the normal regulated voltage at output terminal 14 is 5 volts. When the regulated output voltage reaches 3.5 volts sufficient shutoff current flows through resistor 38 and consequently transistor 42 so as to divert all of the input current through transistor 42, turning transistor 36 off. When transistor 36 is shut off, regenerative action in the regulator causes it to assume a stable operating point at 5 volts.

The start-up circuit of the present invention is designed so that the circuitry for producing the start-up current has a temperature coefficient matched with that of the circuitry for shutting off the start-up current. The temperature coefficient of resistor 32 is matched by that of resistor 38 and the temperature coefficient of diode 34 is matched by the temperature coefficient of diode 40. Thus, if a temperature change caused a reduction in the shutoff current through resistor 38, that same temperature change would cause a similar change in the input current through resistor 32. Thus the operation of the circuit is unchanged by temperature.

An additional feature of the present invention, is that a terminal 44 may be connected to the base of transistor 36. This terminal 44 can be used as a signal to indicate when the regulator is close to regulation. The voltage on terminal 44 will initially be at the forward voltage of diode 34. When the regulator approaches regulation the voltage on terminal 44 will approach ground.

Of course, it should be understood that various changes and modifications to the preferred embodiment described above will be apparent to those skilled in the art. For example, transistors or other equivalent circuitry may replace the diodes to form the current mirrors. Also, the present invention may be used with any of a variety of different band-gap regulator circuits. These and other changes can be made without departing from the spirit and the scope of the invention and without diminishing its attendant advantages. It is therefore intended that such changes and modifications be covered by the following claims.

I claim:

1. A start-up circuit for a voltage regulator comprising:

means for providing an input current;

start-up means responsive to said input current for providing start-up current to said regulator, said start-up means having a temperature coefficient;

means for receiving a regulated voltage from said regulator;

shutoff circuit means responsive to said regulated voltage for shutting off said start-up circuit means, said shutoff circuit means having a temperature coefficient which is substantially the same as the temperature coefficient of said start-up means; and means, connected to said shutoff circuit means, for providing a signal when said start-up means is shut off so as to indicate when said voltage regulator is close to regulation.

2. The startup circuit of claim 1 wherein said start-up means comprises a first current mirror having an input branch for receiving said input current and an output branch for providing start-up current to said regulator.

3. The start-up circuit of claim 1 wherein said means for providing an input current comprises a voltage source and a resistor.

4. The start-up circuit of claim 1 wherein said shutoff circuit means comprises a resistor for generating a shutoff current in response to said regulated voltage and a current mirror having an input branch for receiving said shutoff current and an output branch for diverting said input current from said start-up means.

5. The start-up circuit of claim 4 further comprising means, connected to said resistor, for providing a signal when said start-up means is shut off so as to indicate when said voltage regulator is close to regulation.

6. A start-up circuit for a voltage regulator comprising:

means for providing an input current;

a first current mirror having an input branch for receiving said input current and an output branch for providing start-up current to said regulator;

means for receiving a voltage output from said regulator;

means for generating a shutoff current in response to said regulated voltage; and means responsive to said shutoff current for shutting off said first current mirror.

7. The start-up circuit of claim 6 wherein said means for providing an input current comprises a voltage source and a resistor.

8. The start-up circuit of claim 6 wherein said means for generating a shutoff current comprises a resistor.

9. The start-up circuit of claim 6 wherein said means for shutting off said first current mirror comprises a second current mirror having an input branch for receiving said shutoff current and an output branch for diverting said input current from said first current mirror.

10. The start-up circuit of claim 6 further comprising means connected to said first current mirror for indicating when said voltage regulator is close to regulation.

11. A start-up circuit for a voltage regulator comprising:

means for providing an input voltage;

an input resistor for receiving said input voltage and providing an input current;

a first current mirror having a diode for receiving said input current and a transistor for providing start-up current to said regulator;

means for receiving a regulated voltage output from said regulator;

a resistor connected to said regulated voltage receiving means for providing a shutoff current; and a second current mirror having a diode for receiving said shutoff current and a transistor for diverting said input current from said first current mirror to turnoff said start-up current.

12. The start-up circuit of claim 11 further comprising means connected between said input resistor and said first current mirror for providing a signal when said first current mirror is shut off so as to indicate when said regulator is close to regulation.

13. A start-up circuit for a voltage regulator comprising:

means for providing an input current;

a current mirror having an input branch for receiving said input current and an output branch for providing a start-up current to said regulator, said current mirror having a temperature coefficient;

means for receiving a regulated voltage from said regulator; and shut-off circuit means responsive to said regulated voltage for shutting off said current mirror, said shut-off circuit means having a temperature coefficient which is substantially the same as the temperature coefficient of said current mirror.

14. A start-up circuit for a voltage regulator comprising:

means for providing an input current;

start-up means responsive to said input current for providing start-up current to said regulator, said start-up means having a temperature coefficient;

means for receiving a regulated voltage from said regulator;

a resistor for generating a shut-off current in response to said regulated voltage; and a current mirror having an input branch for receiving said shut-off current and an output branch for diverting said input current from said start-up means to shut off said start-up means, said current mirror having a temperature coefficient which is substantially the same as the temperature coefficient of said start-up means.

* * * * *